US006851201B1

(12) United States Patent
Gioia et al.

(10) Patent No.: US 6,851,201 B1
(45) Date of Patent: Feb. 8, 2005

(54) DRYWALL T-SQUARE

(76) Inventors: Constantine M Gioia, 27 Meier Pl., Bay Shore, NY (US) 11706; Valeska N Gioia, 27 Meier Pl., Bay Shore, NY (US) 11706

( * ) Notice: Subject to any disclaimer, the term of this patent is extended or adjusted under 35 U.S.C. 154(b) by 0 days.

(21) Appl. No.: 10/446,209

(22) Filed: May 27, 2003

(51) Int. Cl.[7] ..... B43L 7/02
(52) U.S. Cl. ..... 33/479; 33/42; 33/492
(58) Field of Search ..... 33/479, 42, 44, 33/474, 476, 492

(56) References Cited

U.S. PATENT DOCUMENTS

| | | | | | |
|---|---|---|---|---|---|
| 581,437 | A | * | 4/1897 | Silliker | 33/43 |
| 844,243 | A | | 2/1907 | Breul | |
| 848,399 | A | * | 3/1907 | Rowell | 33/42 |
| 854,351 | A | | 5/1907 | Hight | |
| 888,985 | A | * | 5/1908 | Finn | 33/33 |
| 965,945 | A | * | 8/1910 | Roman | 33/566 |
| 1,257,683 | A | | 2/1918 | Defenbaugh | |
| 1,293,313 | A | | 2/1919 | Berkoff | |
| 1,877,341 | A | * | 9/1932 | Kurtz, Jr. | 33/492 |
| 2,554,099 | A | * | 5/1951 | Ermold | 33/487 |
| 2,579,664 | A | * | 12/1951 | Gleasman | 33/492 |
| 2,883,753 | A | | 4/1959 | Schoenmaker | |
| 3,343,266 | A | * | 9/1967 | Dolgorukov | 33/479 |
| 3,416,485 | A | | 12/1968 | Phillips | |
| 3,805,390 | A | | 4/1974 | Craig | |
| 4,060,902 | A | * | 12/1977 | Keller | 33/403 |
| 205,795 | A | | 7/1978 | Green | |
| 4,128,030 | A | * | 12/1978 | Kundikoff | 83/745 |
| 245,844 | A | | 8/1981 | Low | |
| 4,514,028 | A | | 4/1985 | Kuo | |
| 4,733,477 | A | | 3/1988 | Fincham | |
| 5,459,937 | A | * | 10/1995 | Albin et al. | 33/479 |
| 5,848,481 | A | * | 12/1998 | Parsons et al. | 33/760 |
| 6,305,093 | B1 | | 10/2001 | Venola | |
| 6,629,370 | B1 | * | 10/2003 | Sposato | 33/42 |

* cited by examiner

*Primary Examiner*—G. Bradley Bennett
*Assistant Examiner*—Tania C. Courson
(74) *Attorney, Agent, or Firm*—Michael I. Kroll

(57) ABSTRACT

An apparatus for marking and scoring a work object has a first member having a first and second side. A flange is connected to a second side of the first member. A second member has a first edge and a second edge. The second member is connected to extend perpendicularly from the first member. The first edge has a plurality of crenulations extending therealong for receiving an instrument. The flange of the first member is positioned against an edge of a work object and the instrument is positioned between adjacent ones of the plurality of crenulations and against the work object. When the first member is moved along the edge of the work object, the instrument is caused to mark or score the work object along a line parallel to the work object.

7 Claims, 10 Drawing Sheets

UTILITY KNIFE (SCORING)

PENCIL USAGE

DRYWALL T-SQUARE

BACKGROUND OF THE INVENTION

1. Field of the Invention

The present invention relates generally to measurement and, more specifically, it is a device to aid in marking lines. This device marks or scores vertically with an added ability to do the same horizontally. The unit has two perpendicularly intersecting and conjoined sections forming a T-shape measuring device commonly known as a T-square.

The present invention, a 48-inch model T-square includes within the elongated sectional edge a plurality of crenulations with outer "V" grooves extending downward the periphery of its sides to the distal end or other predetermined point, to aid the user in processes oriented toward the accurate and straight drawing of lines, marking or scoring in both a vertical and horizontal direction.

The top connected section of the present invention is substantially smaller in length than its compliment and has beveled edges, with the addition of having mounted thereupon a transverse flange that extends lengthwise and thereupon a handle so a user can grasp the handle and place the transverse flange in such a manner that allows the transverse flange to contact a work piece's edge, where then it may be slid against and across the top edge and face in a manner that allows for the centrally and perpendicular joined elongated sections to travel in a straight linear path correlating to a work piece factory or other straight edge.

The crenulations are equally spaced at every ⅛ inch marking from the ⅛ inch mark through the 24 inch mark. In addition they are of equal depth into the side(s) of the straight edge(s) and are tapered or "V" shaped at the outer edge to provide ease of insertion of a tool, such as a carpenter's pencil and/or a utility knife.

In use of existing 48 inch squares the long straight edges are used to score, mark or make lines vertically. Also to set up for horizontal scores or marks by use of the numbers on the edge(s) of the square. This use also requires a mark on both ends of the board. This example is on sheetrock. User needs a 24 inch rip across the board. The user places the square on the right end of the board, makes a mark at 24 inch, then moves to the left end and makes the same mark at 24 inch. The user then has to stretch a chalk line from one mark to the other, pop line, and then score with a utility knife.

The present invention can still mark, make lines or score vertically, but can also on demand, make horizontal cross board lines or scores. The user grasps the handle. Places the transverse flange on the top edge and end of the board. Holding the handle with hand places a utility knife or pencil in the desired crenulation and moves the unit across the work piece to the other end. The line or score is complete.

2. Description of the Prior Art

There are other T-square devices designed for carpentry. Typical of these is U.S. Pat. No. 205,795 issued to Green on Jul. 9, 1878.

Another patent was issued to Low on Aug. 16, 1881 as U.S. Pat. No. 844,243 was issued to Breul on Feb. 12, 1907 and still yet another was issued on May 21, 1907 to Hight as U.S. Pat. No. No. 854,351.

Another patent was issued to Defenbaugh on Feb. 26, 1918 as U.S. Pat. No. 1,257,683. Yet another U.S. Pat. No. 1,293,313 was issued to Berkoff on Feb 4, 1919. Another was issued to Schoenmaker on Apr. 28, 1959 as U.S. Pat. No. 2,883,753 and still yet another was issued on Dec. 17, 1968 to Phillips as U.S. Pat. No. 3,416,485.

Another patent was issued to Craig on Apr. 23, 1974 as U.S. Pat. No. 3,805,390. Yet another U.S. Pat. No. 4,514,028 was issued to Kuo on Apr. 30, 1985. Another was issued to Fincham et al. on Mar. 29, 1988 as U.S. Pat. No. 4,733,477 and still yet another was issued on Oct. 23, 2001 to Venola as U.S. Pat. No. 6,305,093.

U.S. Pat. No. 205,795

Inventor: J. W. Green

Issued: Jul. 9, 1978

A ruler or similar device for drawing lines, having a notched edge, substantially as described.

U.S. Pat. No. 245,844

Inventor: L. Low

Issued: Aug. 16, 1881

A square provided with crenulations or notches along its edges, arranged coincidently with its graduations, substantially as described for the purpose set forth.

U.S. Pat. No. 844,243

Inventor: R. A. Breul

Issued: Feb. 12, 1907

In a try-square, the combination with a blade, of a back formed of sheet metal folded together along its outer edge to form two parallel side portions, the inner edge portions of such back being turned out at a right angle and folded back upon themselves with their two ends disposed flush against each other to form a broad strait inner edge.

U.S. Pat. No. 854,351

Inventor: A. W. Hight

Issued: May 21, 1907

A square having a slot extending length wise the blade, both edges of said slot being notched and the notches on opposite sides being in staggered relation.

U.S. Pat. No. 1,257,683

Inventor: C. C. Defenbraugh

Issued: Feb. 26, 1918

A square having one arm slitted adjacent to the inner edge thereof to form a tongue, the portion of the are carrying the tongue being bent in one direction at right angles to the arm with tongue extending in the opposite direction at right angles to the arm to form integral edge flanges.

U.S. Pat. No. 1,293,313

Inventor: V. Berkoff

Issued: Feb. 4, 1919

An article of manufacture comprising s resilient normally bowed plate adapted to be pressed flat against a drawing surface, and having a plurality of series of openings disposed lengthwise therein and parallel arrangement and also having tapered supporting members on its ends to lift the body of the said plate above the drawing surface when bowed.

U.S. Pat. No. 2,883,753

Inventor: A. Schoenmaker

Issued: Apr. 28, 1959

An instrument for laying out basic grid lines, comprising top, bottom and side strips joined at there ends to form a rectangular frame, each of said strips having flat upper and lower surfaces and strait outer edges with the outer edges of the top and bottom strips in parallel relation with each other and with the outer edges of the side strips in parallel relation with each other and perpendicular relation with the outer edges of the top and bottom strips, each of the top and bottom strips being provided with a plurality of spaced slots formed in the inner edge thereof perpendicular to the straight outer edge of the strip, with the straight sides of the slots being in parallel relation with each other, and each of the straight sides of the slots of one of the top and bottom members being in direct alignment with a companion straight side in the other of the top and bottom strips, each of the side strips being provided with a plurality of spaced slots formed in the inner edge thereof and each of said slots having a straight side thereof perpendicular to the straight outer edge of the strip, with such straight side of the slots being in parallel relation with each other and each of the straight sides of the slots of one of the side strips being in direct alignment with a companion straight side in the other of the side strips, and the straight sides of each of the slots of the top and bottom strips being perpendicular to the straight sides in each of the slots of each of the side strips.

U.S. Pat. No. 3,416,485

Inventor: Chester W. Phillips

Issued: Dec. 17, 1968

A scoring aid for manual manipulation comprising: an elongated body having opposed edges, a first and second series of undulations carried by one of said edges, a medial edge portion separating said first and second series of undulations to initially receive the index fingers of respective right and left hands during use, subtractive factor indicia carried by said body corresponding to individual undulations of said body corresponding to individual undulations of said second series, whereby, the scorer manually moves respective index fingers along said edge to sequentially apply partial score counts and to thereby provide a cumulative score for a multiple part exercise.

U.S. Pat. No. 3,805,390

Inventor: Henry A. Craig

Issued: Apr. 23, 1974

A target marker for drawing targets by hand on paper such as discarded paper products including cardboard boxes, newspapers, paper bags, wall paper, wrapping paper, and the like. The marker may be made from wood, paper, plastic or metal and has a strait edge on its righthand side, the left hand edge has notches at 1 inch intervals, the marker is 2 inches wide and is provided with notches and a slot suitably located to mark the positions for the horizontal and vertical zero lines of a target. The marker has an anchor pin hole near the bottom to receive an anchor pin which can be inserted therethrough. A plurality of holes for admitting a pencil point are formed in the marker at spaced positions for marking targets.

U.S. Pat. No. 4,514,028

Inventor: Wei H. Kuo

Issued: Apr. 30, 1985

An apparatus for readily identifying the pin number and total number of pins of an integrated circuit having multiple leads or pins arranged in two substantially parallel rows is provided. The apparatus has a rectangular frame with opposite ends of predetermined width and sides having a plurality of notches. The notches are formed so that when at least one of the sides is placed adjacent the pins, each of the pins fits substantially inside one of the notches. Labeling means are placed on at least one of the faces of the apparatus for correlating a predetermined notch with a pin of the integrated circuit.

U.S. Pat. No. 4,733,477

Inventor: James R. Fincham

Issued: Mar. 29, 1988

A chalk line framing square is provided to aid in placing right angle intersecting chalk lines upon a floor so that tiles can be properly installed on the floor. The framing square can check the squareness of the tiles as they are installed without being placed in the adhesive.

U.S. Pat. No. 6,305,093

Inventor: Penelope E. Venola

Issued: Oct. 23, 2001

A leveling and centering tool including a linear rail having a centering scale on one edge thereof and including numerals ascending upwardly in opposite directions from a centering point. A measurement scale having incremental spaces twice the size of the spacing on the centering scales and including the opposite edge of the rail. Leveling bubbles are incorporated on the scale and it may include a hand grasp.

While these marking devices may be suitable for the purposes for which they were designed, they would not be as suitable for the purposes of the present invention, as hereinafter described.

SUMMARY OF THE PRESENT INVENTION

A primary objective of the present invention is to provide a T-square having a plurality of crenulations and grooves extending from the ⅛" mark to the 24" mark at ⅛ inch intervals on the T-squares side or sides used for the engagement there of a carpenters pencil or scoring knife during a displacement that is linear amongst the side of a standard raw sheet of planer material, typically for horizontal type marks, lines or scores.

Another objective of the present invention is to provide a T-square having a handle fixed upon the upper section to aid in the steadying and displacing of the T-square along and edge.

Yet another objective of the present invention is to provide a T-square having a transverse flange to catch the top and outside edge of a work piece and provide accurate square placement of the elongated section amongst the surface of a work piece.

Still yet another objective of the present invention is to provide a T-square having indica of length that is dependant on the length of the elongated side, that is marked in either a concurrent or continuing manner from a determined side.

Another objective of the present invention (48 inch model) is to provide a T-square having one straight edge for aiding the user in making accurate vertical cuts or scores on a workpiece.

Yet another objective of the present invention is to provide a T-square having two perpendicularly joined sections having opposing strait edges to allow the present invention to be used as a squaring tool.

Still yet another objective of the present invention is to provide a T-square having crenulations and "V" grooves of adequate size and shape to accommodate a carpenter's pencil or utility knife. The carpenter's pencil fits in the "V" grooves and the utility knife fits in the crenulations.

Additional objects of the present invention will appear as the description proceeds.

The present invention overcomes the shortcomings of the prior art by providing a T-square with a handle and transverse flange used to guide and manipulate the present invention across the edge of a work piece in a predetermined direction so as to allow for an extending section with opposing straight edge sides having crenulations with "V" grooves on one or both sides, for the guiding of a marking or scoring tool, that may be placed in square relation to a work piece edge and manipulated further manually in an accurate manner for the making of horizontal and/or vertical marks, lines or scores.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
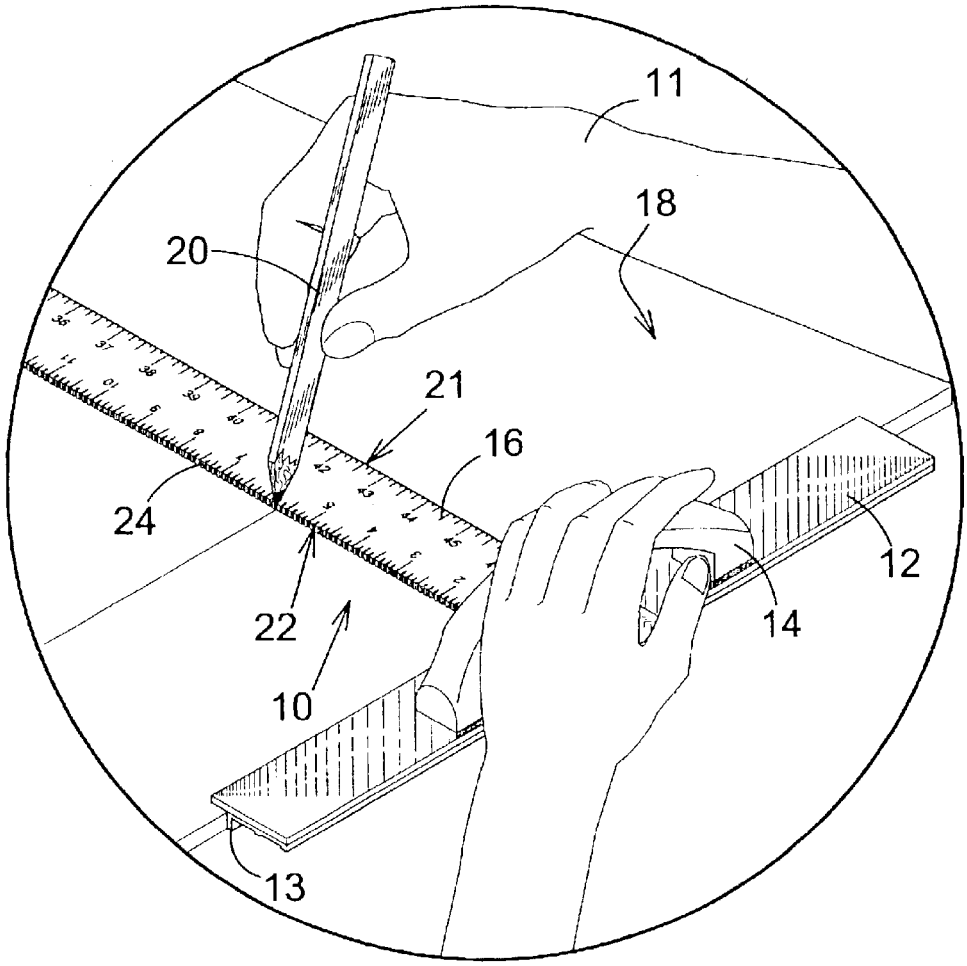
FIG. 1 is an illustrative view of the present invention in use.

Turning now descriptively to the drawings, in which similar reference characters denote similar elements throughout the several views, the Figures illustrate the T-square of the present invention. With regard to the reference numerals used, the following numbering is used throughout the various drawing figures.

10 T-square of the present invention
11 user
12 first member
13 flange
14 handle
16 second member
17 edge of work object
18 work object
19 Face of work object
20 marking instrument
21 first edge of the second member
22 second edge of the second member
24 crenulation
25 chamfered corner of 24
26 screw
27 cutting instrument
28 resulting line
29 directional line
32 indicia
33 access angle
34 beveled ends of 12
36 arcuate ends of 13

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is the present invention 10 is a T-square having a first member 12 and a second member 16 extending perpendicularly therefrom with slot-like crenulations 24 within the opposing straight edges 21,22 providing means for inserting and guiding a pencil 20, utility knife blade 28 or other tool. The aforementioned crenulations 24 have chamfered or arcuate corners 25 to guide the cutting instrument 28 or marking instrument 20 into said crenulation 24 to provide for horizontal or cross board drawing of lines or scoring 29. Said first member 12 consists of a handle 14 and transverse flange 13 for allowing a user 11 to move the T-square 10 along a selected workpiece edge 17. The crenulations 24 have chamfered corners 25 forming a tapered "V" entry into each crenulation 24 that provide alignment for a pencil 20 or the placement of a utility knife 28 to travel in a predetermined direction 30.

Figure 2:
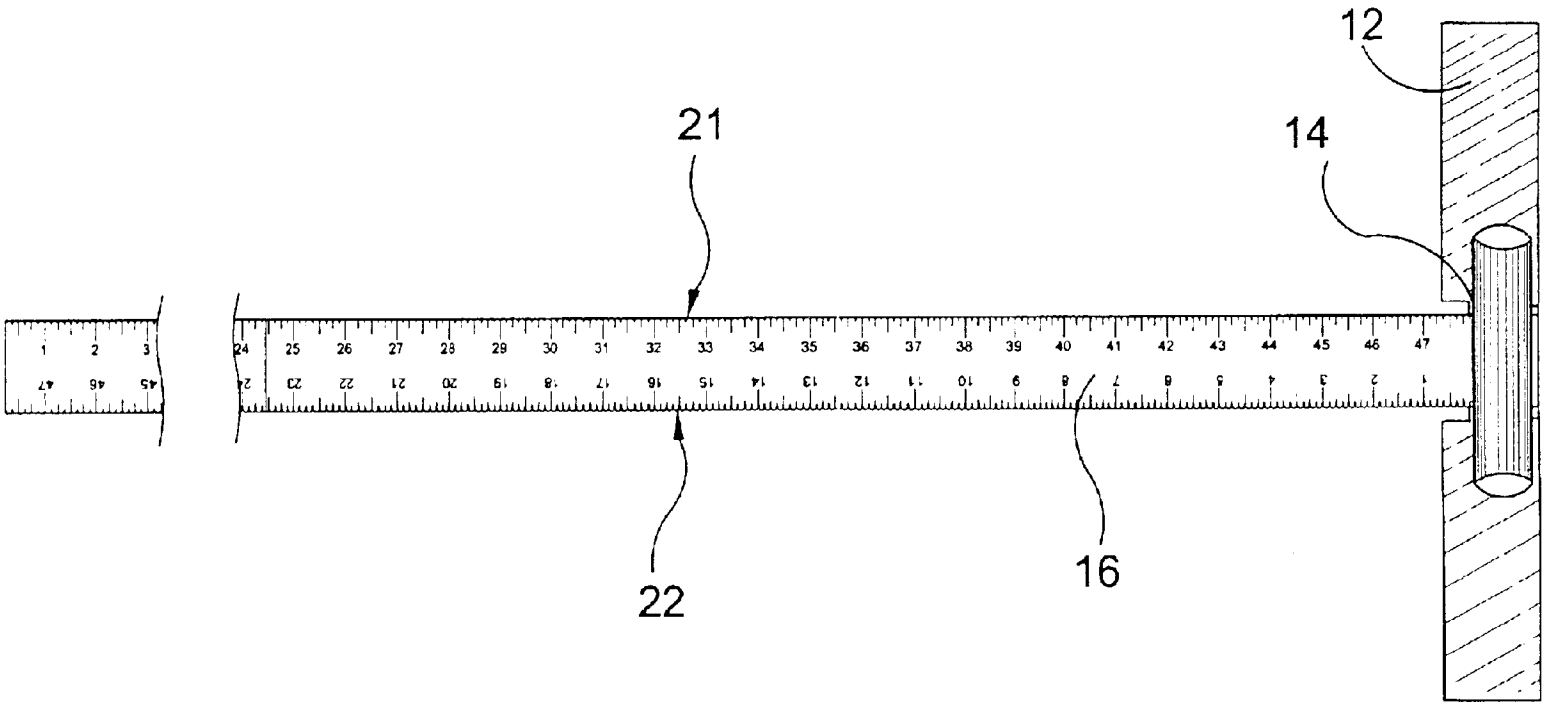
FIG. 2 is a top view of the present invention.

FIG. 2 is a top view of the present invention 10. Shown is a top view of the present invention 10 having crenulations 24 selectively placed along indication markings 32 on at least one of the straight edges 21,22 of said second member 16. When in use, the transverse flange 13 of the device is placed on an edge of a selected workpiece 18. With one hand on the handle 14 to move the T-square 10 and the other having a tool such as a utility knife 28 or pencil 20 positioned within a desired crenulation 24, the T-square 10 is moved along the workpiece edge 17 making a line 29, marking or scoring 29 the workpiece 18.

Figure 3:
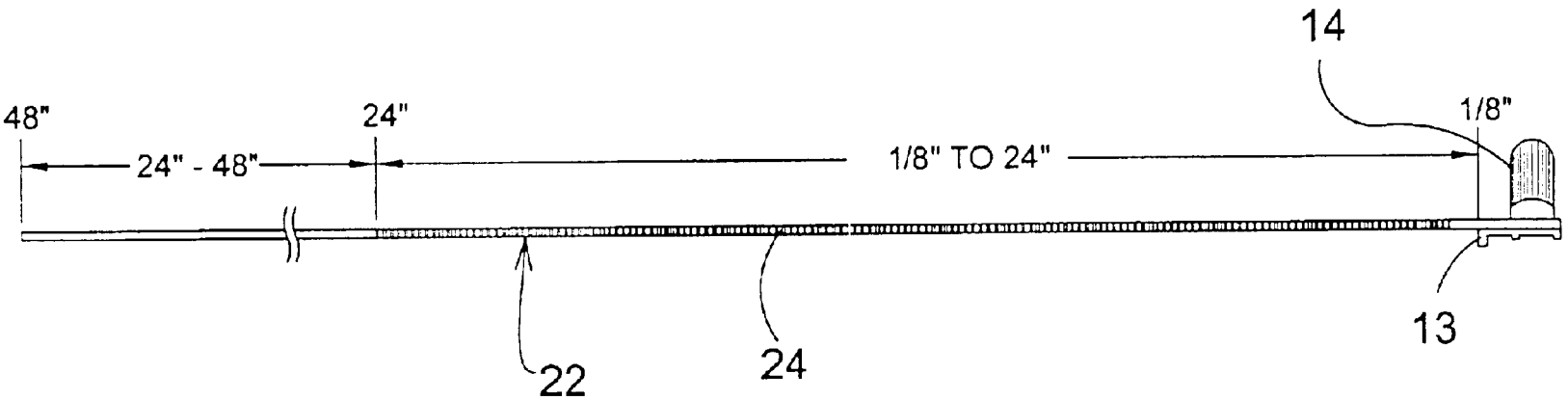
FIG. 3 is a side view of the present invention.

FIG. 3 is a side view of the present invention 10. Shown is a side view of the first member 12 having a transverse flange 13 with a handle 14 positioned thereon for moving the T-square 10 perpendicularly along a workpiece edge 18. Also shown are selectively placed crenulations 24 spanning from ⅛ inch to 24 inches along the straight edges 21,22.

Figure 4:
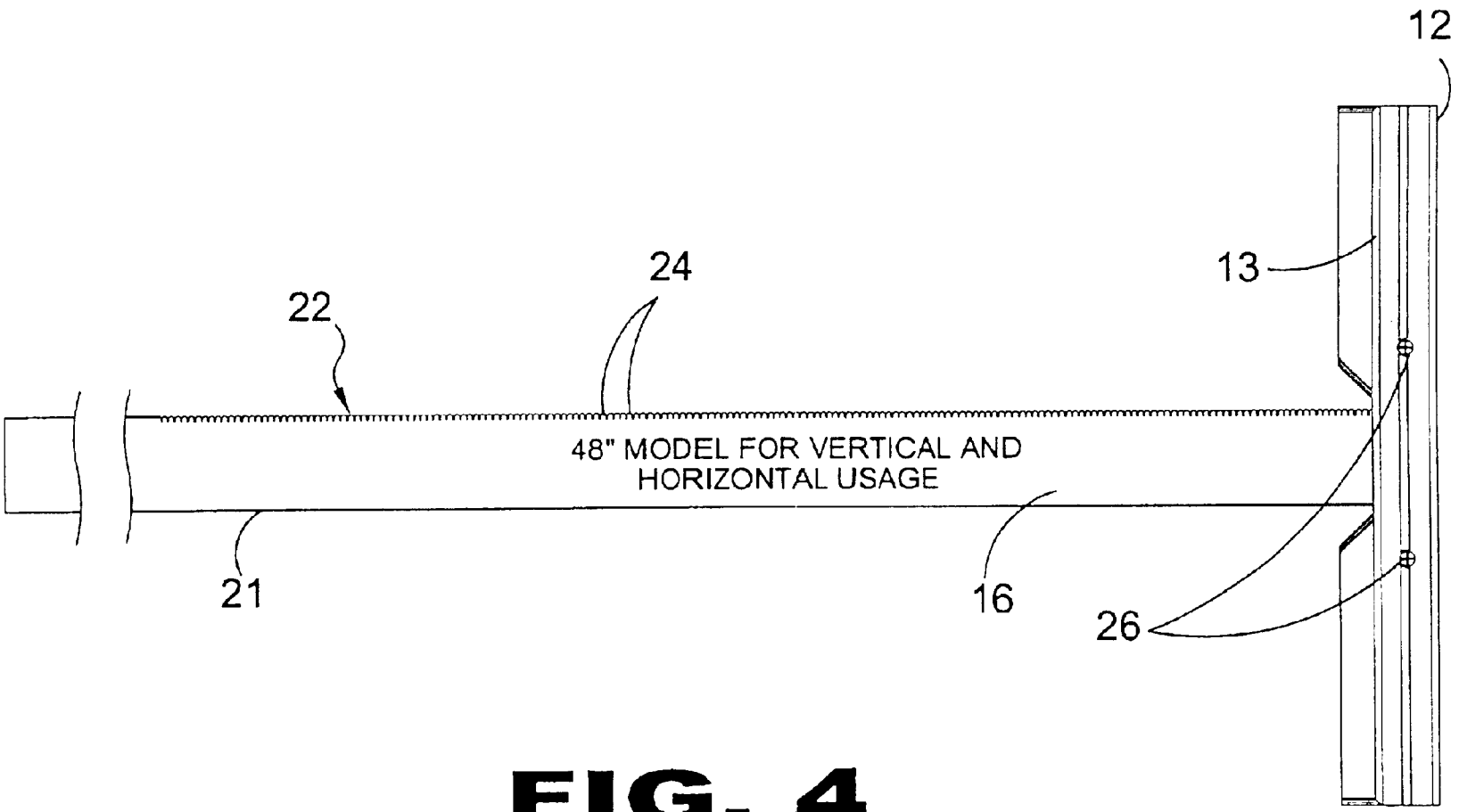
FIG. 4 is a back view of the present invention.

FIG. 4 is a bottom view of the present invention 10. Shown is a bottom view of said invention 10 revealing the transverse flange 13 and attached hardware 26. The flange 13 slides across face of work piece 18 with the peveled portions away from the face of the work piece 18. Also shown are the crenulations 24 along the first edge 21 and the second edge 22 of said second member 16. The crenulations 24 are cut to an equal depth along said edges 21,22 from ⅛ inch to 24 inch and include chamfered corners 25 on the outer edges for ease of insertion of a tool, such as a utility knife 28 or a carpenter's pencil 20.

Figure 5:
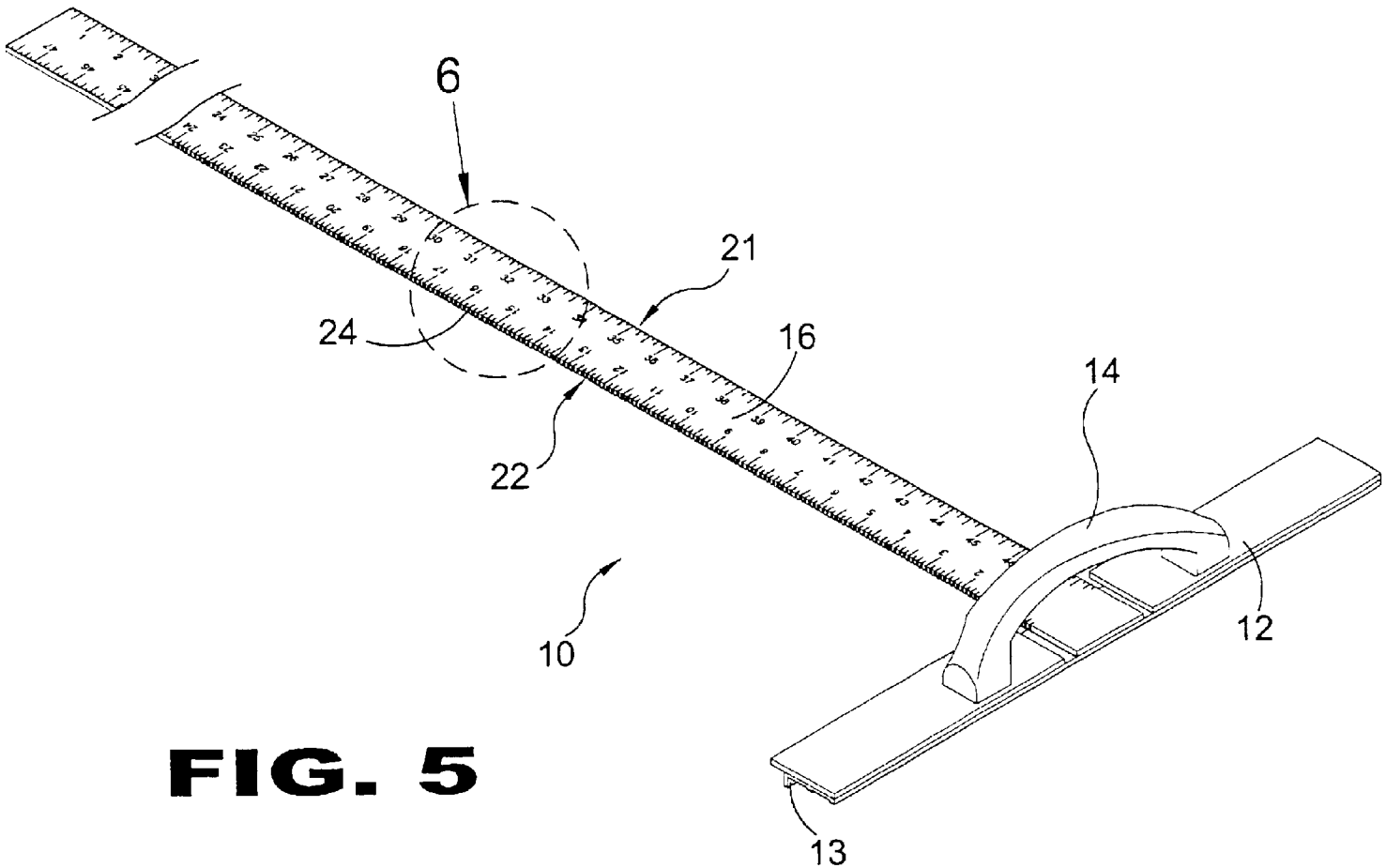
FIG. 5 is perspective view of the present invention.

FIG. 5 is perspective view of the present invention 10. Shown is a perspective view of the present invention 10 with the first member 12 having crenulations 24 providing means for inserting and guiding a pencil 20, utility knife 28 or other marking or scoring tool. The second member 16 includes a transverse flange 13 on the underside and a handle 14 for moving the T-square 10 along the face and edge 17 of workpiece 18.

Figure 6:
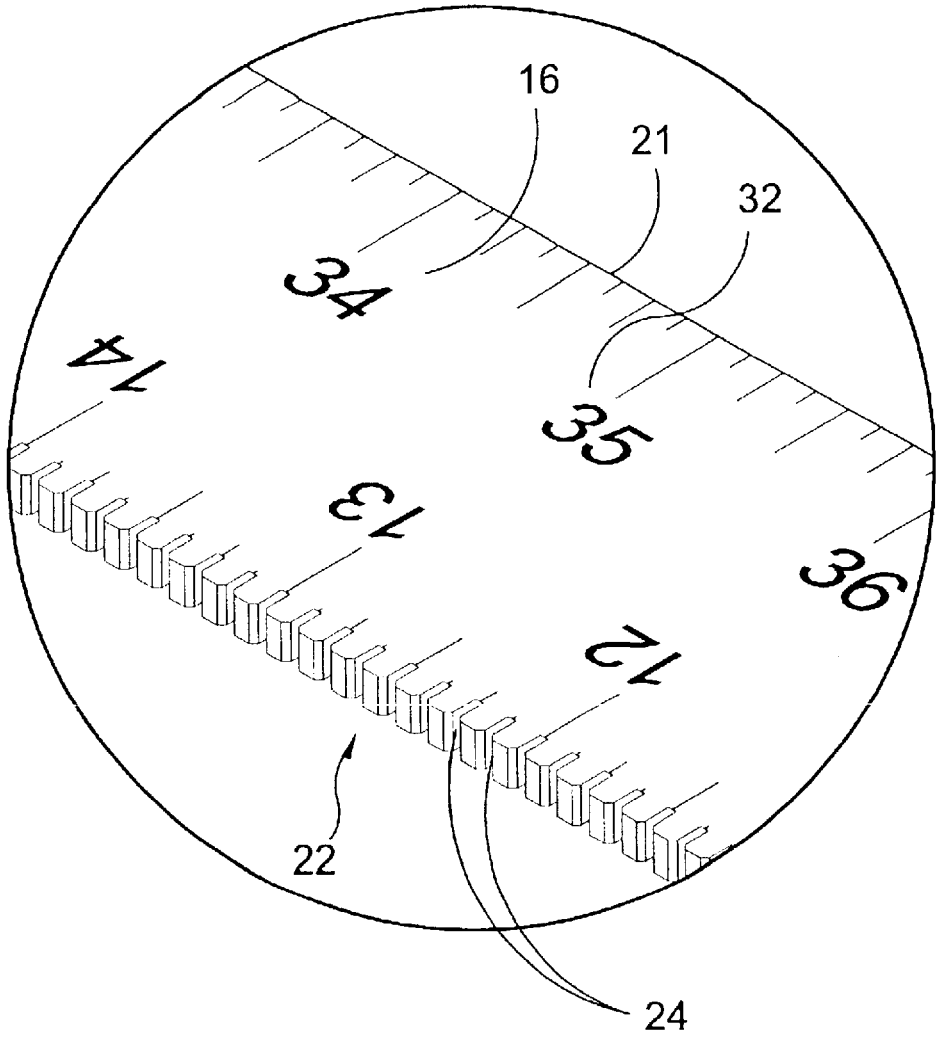
FIG. 6 is a detailed perspective view of the present invention.

FIG. 6 is a detailed perspective view of the present invention 10 taken from FIG. 5 as indicated. Shown is a detailed view of the crenulations 24 of equal depth along the second edge 22 of said second member 16 with corresponding indicia 32 providing means for inserting a tool such as a utility knife blade 28 or pencil 20 at a specific point. Each crenulation 25 having a tapered "V" entry formed by chamfered corners 25 for ease of insertion and alignment of the tool in use, as the T-square 10 travels in a predetermined direction 30 allowing the inserted tool to mark, line or score along said course. Also shown is a partial view of the indicia 32 on opposing edges that differ, but are aligned.

Figure 7:
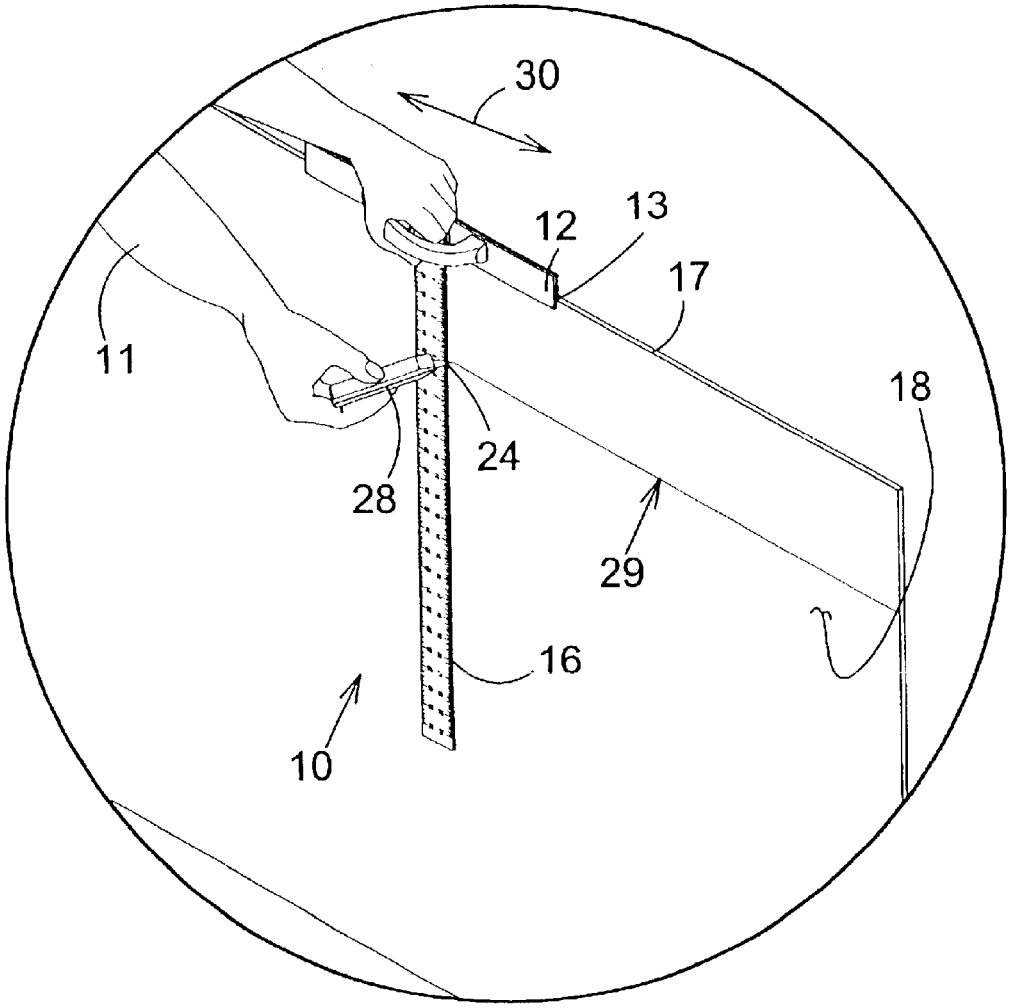
FIG. 7 is an illustrative view of the present invention in use.

FIG. 7 is an illustrative view of the 24¼" embodiment of the present invention 10 in use. Shown is a crenulation 24 along the second edge 22 of said second member 16, providing means for inserting a tool such as a utility knife 28 as shown. Each crenulation 24 consists of a right and left wall having chamfered corners 25 to taper towards the outer edge and provide alignment to the tool in use. The T-square 10 is moved with the flange 13 engaging an edge of the workpiece 17 allowing the inserted tool 20,28 to make a score or mark 29 along a horizontal or cross course.

Figure 8:
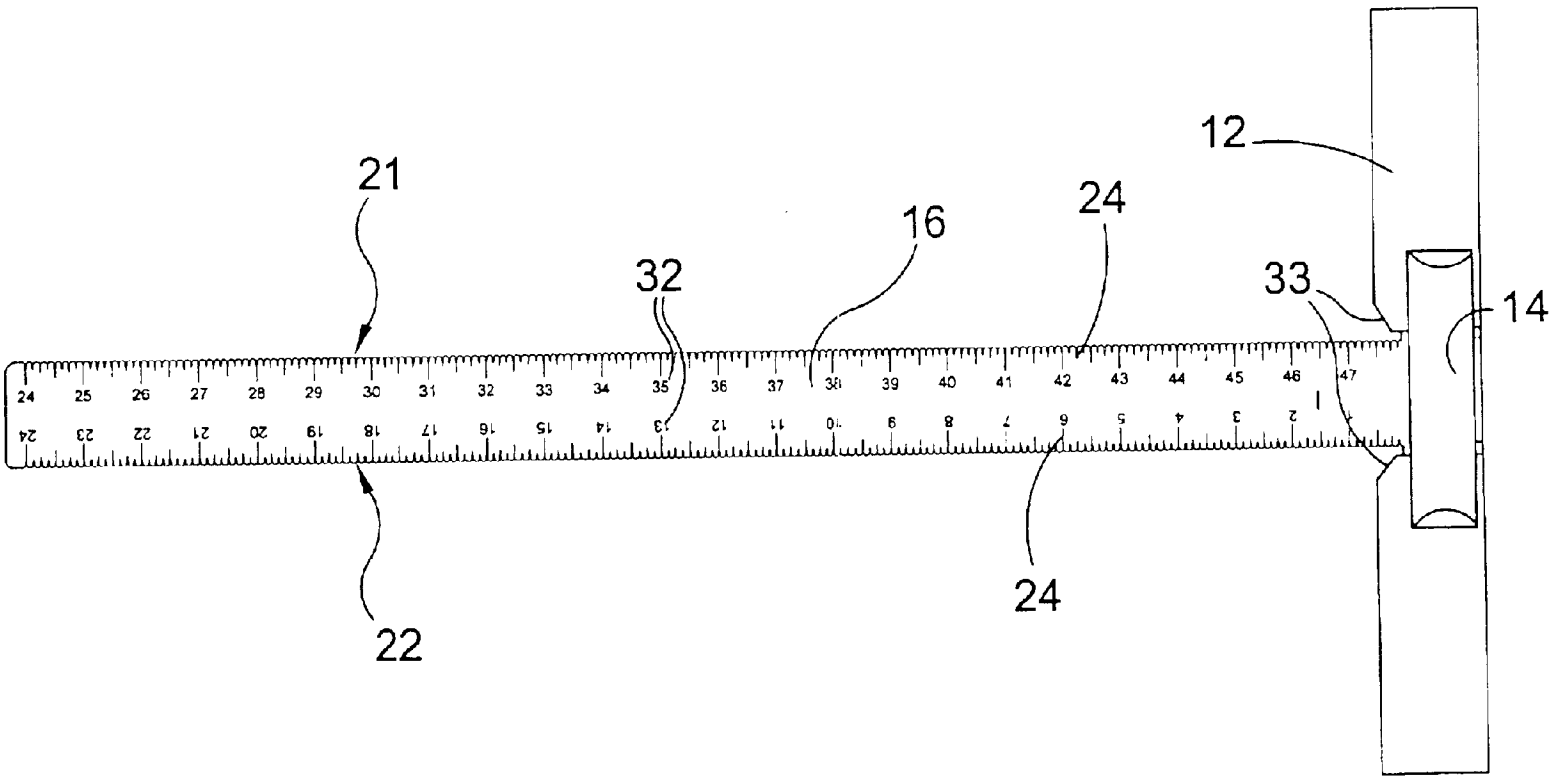
FIG. 8 is a top view of the present invention.

FIG. 8 is a top view of the present invention 10. Shown is a top view of the present invention's 24¼ inch model having crenulations 24 on both the first edge 21 and the second edge 22 of said second member 16, a transverse flange 13 with arcuate ends 36 with handle 14 and inner access angles 33 on said first member 12. The access angles 33 allow the user 11 to measure and mark the workpiece 18 area that would ordinarily be obstructed by said first member 12.

Figure 9:
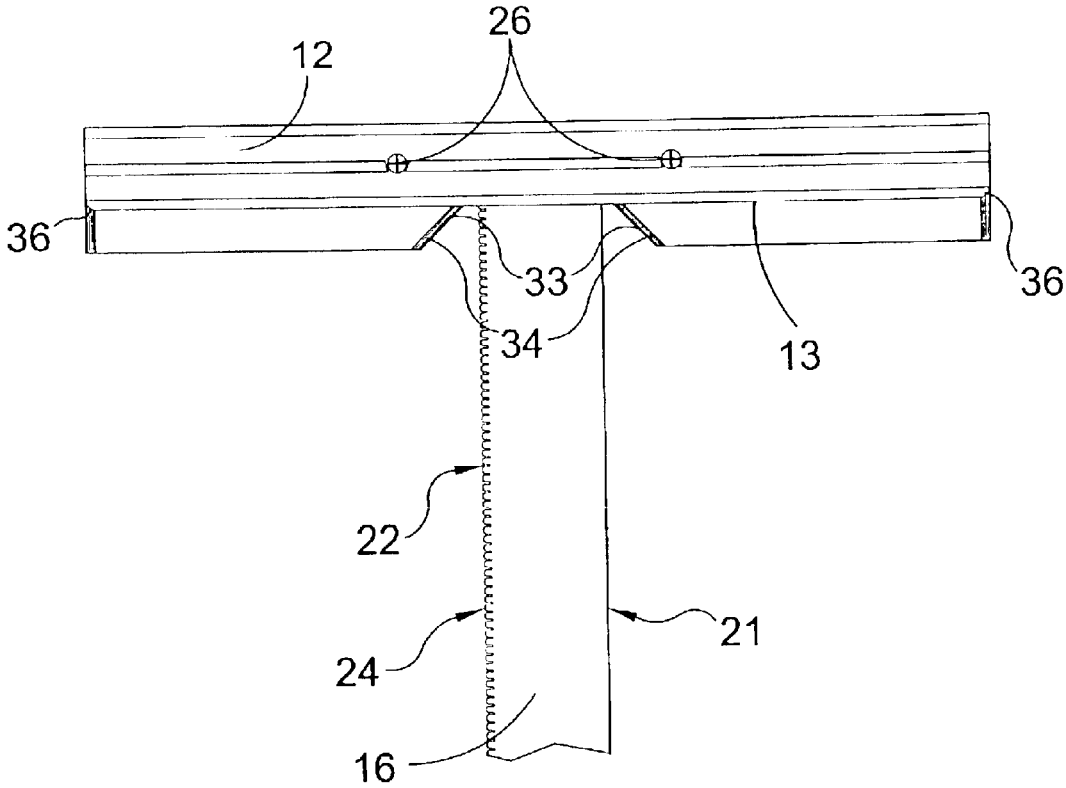
FIG. 9 is a rear view of the present invention.

FIG. 9 is a rear view of the present invention 10. Shown is a bottom view of the invention 10 revealing the first member 12 having beveled ends 34 on the bottom side thereof and arcuate ends 36 on the transverse flange 13 to allow for the smooth movement along the workpiece 18 without having sharp edges to get caught thereon. The beveled ends 34 and arcuate ends 36 are on both 24¼" and 48" models. Also shown are the crenulations 24 along the straight edge portion of the T-square 10. The crenulations 24 are cut to an equal depth along the straight edge from ⅛ inch to 24 inch and include chamfered corners 25 forming a tapered V-shaped entryway into said crenulations 24 for ease of insertion of a tool therein, such as a utility knife 28, or a carpenter's pencil 20.

Figure 10:
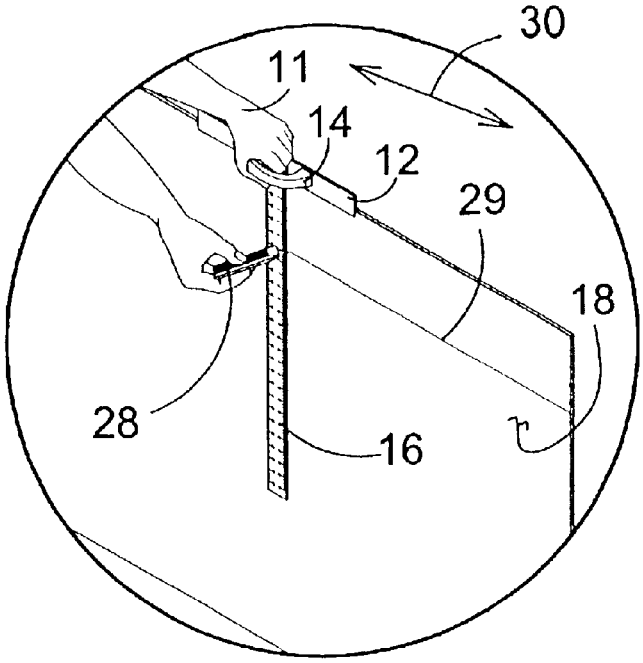
FIG. 10 is illustrative views of the present invention.
Figure 10:
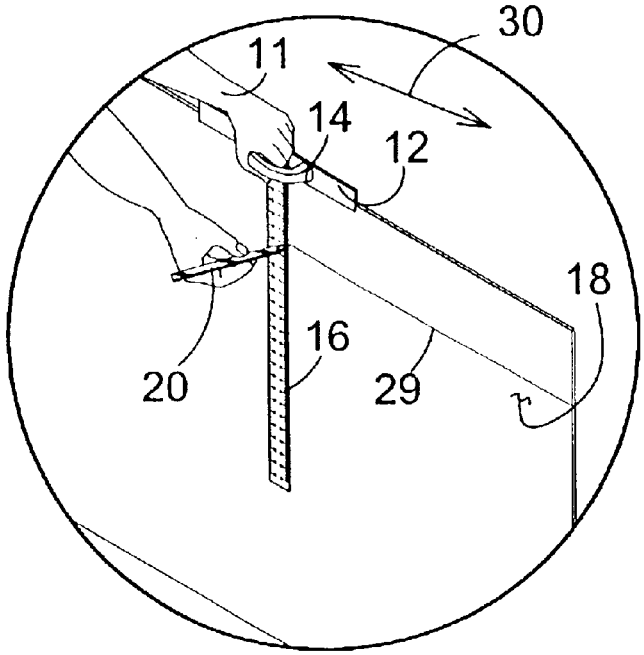

FIG. 10 is an illustrative view demonstrating two applications of the present invention 10 in use. Shown is the T-square of the present invention 10 providing crenulations 24 with "V" grooves for the insertion of a pencil 20, utility knife 28 or other tool allowing for horizontal or cross board drawing of lines or scoring.

What is claimed is new and desired to be protected by Letters Patent is set forth in the appended claims:

1. An apparatus for marking and scoring a work object comprising:

a) a first member having a first and second side and made up of two spaced parts;

b) a flange connected to said second side of said first member and joining said two parts;

c) a second member having a first edge and second edge, said second member being connected to extend perpendicularly from said first member and between said two parts and resting on said flange, said first edge including a plurality of crenulations formed therein extending therealong for receiving an instrument, said flange having a downwardly extending projection for sliding against a work object, wherein upon positioning of said flange of said first member with said projection against an edge of said work object and positioning the instrument between adjacent ones of said plurality of crenulations and against the work object, whereby when said first member is moved along the edge of the work object the instrument is caused to mark the work object along a line parallel to the edge of the work object;

d) upper and lower surfaces of said first member being in same planes as said upper and lower surfaces of said second member so that said flange is capable of guiding said apparatus along said edge of said work object;

e) said first member having inner access angles in said parts adjacent the first and second edges of said second member to allow access to work object areas what would otherwise be obstructed by said first member, said access angles having edges beveled away from said work object; and f) said crenulations having chamfered corners forming a "V" shaped opening.

2. The apparatus as recited in claim 1, further comprising a handle connected to a first side of said first member for steadying and guiding said apparatus against said object.

3. The apparatus as recited in claim 1, wherein said second member includes indicia identifying units of measurement.

4. The apparatus as recited in claim 3, wherein said indicia mark said second side at intervals of at least every ⅛ of an inch along the length thereof.

5. The apparatus as recited in claim 1, wherein the second member has a length substantially between the range of 12 inches and 48 inches.

6. The apparatus as recited in claim 1, wherein said apparatus is formed from at least one of metal, wood, and plastic.

7. A method of marking and scoring a straight line in a work object consisting of the steps of:

a) positioning a flange mounted on a side of a crossbar of a T-square against a side of the work object, said work object being a sheet of drywall, said crossbar consisting of two spaced parts on said flange said flange having downwardly extending projection;

b) inserting one of a marking instrument and a cutting instrument in a selected crenulation positioned on a first edge of a member of the T-square extending perpendicular to said crossbar between and spaced from said parts, said first edge having a plurality of crenulations formed therein, whereby the one of the marking and cutting instrument is positioned against the work object, upper and lower surfaces of said crossbar and second member being in a same plane, respectively, so that said projection on said flange is capable of guiding said T-square along said side of said work object, said crossbar having inner access angles in said parts adjacent said first edge and a second edge of said to allow access to work object areas which would otherwise be obstructed by said crossbar, said access angles having edges beveled away from said work object, and said crenulations having chamfered corners forming a "V" shaped opening;

c) gripping a handle positioned on a side of said crossbar opposite the flange and moving the T-square along the length of the edge of the work object; and d) marking or scoring a straight line in the object at a distance from the edge of the work object corresponding to the selected crenulation on the first edge of the member.

* * * * *